US005212427A

United States Patent [19]

Jones

[11] Patent Number: 5,212,427

[45] Date of Patent: May 18, 1993

[54] ELECTRONIC LAMP BALLAST DIMMING CONTROL MEANS EMPLOYING PULSE WIDTH CONTROL

[75] Inventor: William H. Jones, Villa Park, Ill.

[73] Assignee: Appliance Control Technology, Inc., Addison, Ill.

[21] Appl. No.: 814,510

[22] Filed: Dec. 30, 1991

[51] Int. Cl.[5] ..... H05B 41/29; H05B 41/391

[52] U.S. Cl. ..... 315/224; 315/209 R; 315/226; 315/291; 315/DIG. 4

[58] Field of Search ..... 315/209 R, 224, 307, 315/DIG. 4, DIG. 5, 226, 291; 331/36 R, 36 L, 65, 113 A, 181; 334/4, 17, 27

[56] References Cited

U.S. PATENT DOCUMENTS 2,915,637 12/1959 McAdam ..... 334/4
4,677,345 6/1987 Nilssen ..... 315/DIG. 4 X
5,004,959 11/1991 Nilssen ..... 315/209 R X

*Primary Examiner*—David Mis
*Attorney, Agent, or Firm*—Robert J. Black

[57] ABSTRACT

An electronic ballast for use with fluorescent lamps including a dimming means consisting of a permanent magnet supported over and in proximity to a dual toroid coil assembly utilized as part of an included inverter circuit included in the ballast. The permanent magnet is movable to control the amount of saturation of the transformers thus determining the width of pulses generated by the transistors included in the inverter circuit and thereby controlling the intensity of light emitted from the fluorescent lamps.

6 Claims, 1 Drawing Sheet

ELECTRONIC LAMP BALLAST DIMMING CONTROL MEANS EMPLOYING PULSE WIDTH CONTROL

BACKGROUND OF THE INVENTION

1. Field of the Invention

The present invention relates to fluorescent lamp ballasts and more particularly to apparatus for controlling the power level generated so the amount of produced illumination may be varied from full brightness down to no light at all.

2. Background Art

The control of the brightness of illuminating systems is well known and is relatively simple particularly for incandescent lights. On the other hand, fluorescent lights, while more economic to operate than incandescent lamps cannot be controlled by simple rheostat type devices. The control of dimming for fluorescent lamps typically employs special and much more costly and sophisticated ballasts in conjunction with other circuitry to achieve illumination intensity control.

A number of patents have been discovered which disclose the dimming of fluorescent lamps. These include the following:

U.S. Pat. No. 4,286,195 to Swinea Jr. which teaches a fluorescent lamp dimming circuit limited to DC fluorescent lighting circuits with a type using a battery voltage source and an inverter. The DC input is interrupted by chopping up the current, thus the controls power the ballast by pulsive energy.

U.S. Pat. No. 4,558,262 to Longenderfer et al teaches a simple dimmer for use with a bank of ballasts and located ahead of the ballast itself, but not located within the ballast as is taught in the present invention.

U.S. Pat. No. 4,568,870 to Chikuma teaches the use of a phase control device for regulating the illumination of a fluorescent lamp. Again the dimmer is located ahead of the ballast in series therewith and employs a conventional triac incandescent lamp dimmer circuit. It is doubtful whether the circuit will properly operate, since when dimming occurs the bimetal start switch would cause the lamp to flash on and off.

U.S. Pat. No. 4,792,729 to Peters teaches a load side phase control circuit in conjunction with the conventional fluorescent light ballast with an isolation transformer to achieve fluorescent lamp brightness control. A resistor and capacitor connected in series shunt the phase control circuit to maintain low level illumination when the phase control circuit is non-conducting.

U.S. Pat. No. 4,937,504 to Black, Jr. et al teaches a time delay circuit for start up of a ballast. It obviously is intended for use with a dimmer unit located ahead of the ballast but not built within the ballast itself as taught by the present invention.

U.S. Pat. No. 4,950,963 to Sievers again teaches a device located ahead of the ballast rather than within as in the present invention, but employs a triac dimmer with a timer to disable the dimmer on startup.

U.S. Pat. No. 4,994,718 to Gordin employs a capacitor in series with the ballast to reduce lamp voltage. By changing the value of the capacitor a certain amount of dimming is achieved. Again the capacitor is not included within the ballast circuitry but rather is located between the ballast and the lamp. It is doubtful whether this circuitry would be operable at low light levels.

U.S. Pat. No. 4,998,046 to Lester employs variable pulse modulation to control the dimming by including a separately powered constant voltage filament arrangement. In practice it becomes necessary to increase the filament voltage as the light level decreases to make up for the loss in arc current. The requirement for a constant filament voltage would probably be very expensive and of questionable operational value.

U.S. Pat. No. 5,004,959 to Nilssen teaches a modified ballast for gas discharge lamps wherein the lamp current control means are utilized to vary the current magnetic flux saturation and in response to the magnetic flux applied controls the frequency of the AC voltage. It indicates that the lamp operating current supplied is dependent on the frequency of the alternating current voltage. It is stated in this patent that the magnetic flux means is magnetically coupled with the charge and control means adapted to provide control of magnetic flux to the control means to permit control of the frequency of the AC voltage and thereby the magnitude of the lamp operating current.

A careful review of the teachings of this patent indicates that the collector current of the transistor varies with dimming and the width of the current pulse decreases with an increase in dimming, and that the frequency only increases slightly. It is not the frequency but rather the duration of the pulse that determines the light level of the associated fluorescent lamp. For example, at 100% light level it has been determined that the transistors are conductive 76% of the time and at 10% of the light level they are conductive only 64% of the time. This change in duty cycle of transistors doesn't explain why the lamp goes from 100% down to a very light output level. The reason appears that the lamp impedance increases as the energy to the lamp decreases. Thus, it has been determined that in the circuitry as shown the lamp resistance changes with dimming and will significantly affect the total circuits electrical characteristics. A minor decrease in pulse width on time of the transistors will result in a large change of lamp output.

SUMMARY OF THE INVENTION

In typical series tuned circuit arrangements employed in electronic ballasts, a dual toroid is utilized to switch on and off the two power transistors. The turns ratio between primary and secondary on each toroid normally controls the on time of each transistor, with the on time establishing the amount of power delivered to the lamp load during each cycle.

Lamp current flowing through the primary winding on the toroids creates a magnetic field. As the current magnitude builds up, it will eventually drive the ferrite material of the toroids into magnetic saturation. It was determined that by introducing a secondary magnetic field it is possible to partially saturate the toroid material. This results in changing the time for the ferrite material to become totally saturated during each on cycle. The net effect therefor is the duty cycle may be determined by the use of an adjustable permanent magnet. Control of the duration of the duty cycle permits dimming of the lamp.

DESCRIPTION OF THE PREFERRED EMBODIMENT

Figure 1:
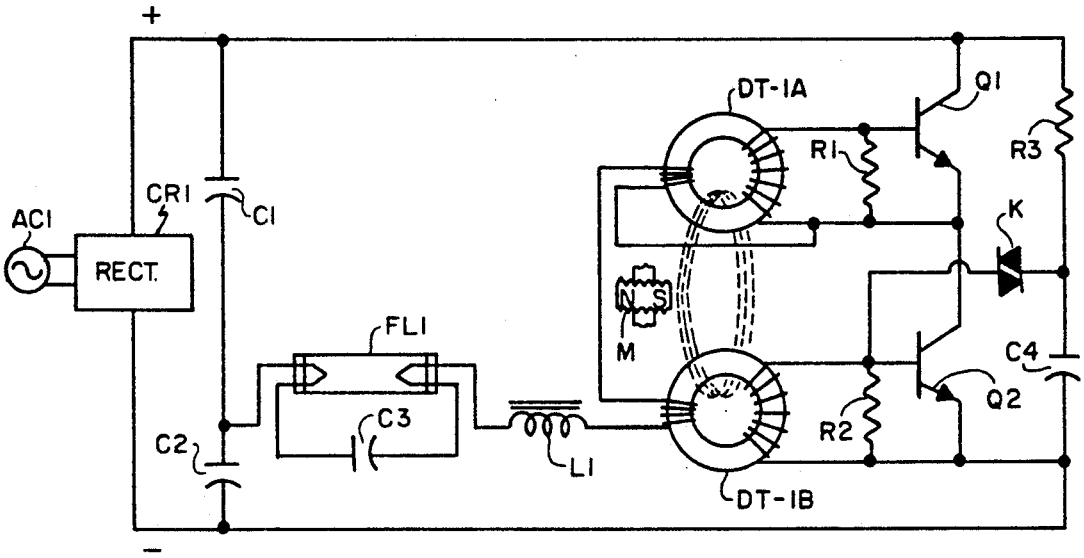
FIG. 1 is a schematic ballast circuit for fluorescent lamps employing a permanent magnet to control saturation of the dual toroid transformer used in the circuit.

Referring now to FIG. 1, a fluorescent lamp ballast with means to control lamp intensity is shown. As seen in FIG. 1, a source of alternating current AC1 such as 120 V 60 Hz. is provided. AC1 is connected to a full wave rectifier CR1. The outputs of which are connected to positive and negative busses. The remaining circuit is essentially a self-oscillating inverter, capacitors C1 and C2 are connected in series across the positive and negative busses. A first transistor Q1 is connected with its collector to the positive bus and its emitter to the collector of transistor Q2 whose emitter in turn is connected to the negative bus.

A dual toriodal transformer assembly consisting of DT-1A and DT-1B acts as current feedback transformers to transistors Q1 and Q2, respectively. The secondary winding of DT-1A is connected across the base emitter junction of transistor Q1 while the secondary winding of DT-1B is connected across the base emitter junction of transistor Q2. From the junction of capacitors C1 and C2 one of the outputs to the lamp circuit is taken while the other is taken through coil L1 from the primary winding of toroid DT-1B. Resistor R3 is connected between the positive bus to capacitor C4 of the negative bus with diac K connected to the junction between resistor R3 and capacitor C4. Diac K in turn has its other terminal connected to the base of transistor Q2.

Figure 2:
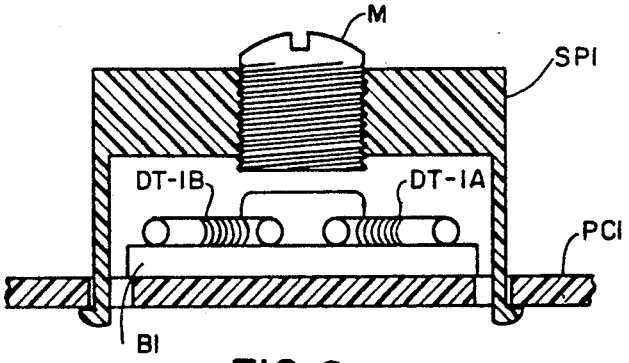
FIG. 2 is a stylized cross sectional view of a permanent magnet as used in the present invention with appropriate support means.

Adjacent to the dual toroid assembly consisting of DT-1A and DT-1B is permanent magnet M which by adjustment means shown in FIG. 2 permits the saturation of toroids DT-1A and DT-1B.

As may be seen by referring to FIG. 2, the two toroid coils DT-1A and DT-1B are mounted in close proximity to each other as a transformer assembly. This assembly is mounted on base B1 and assembled to a printed circuit card PC1. Suspended over the dual toroids DT1 and DT2 is support SP1 which holds a permanent magnet M in the form of a set screw. By means of a screw driver or similar means magnet M can be moved in or out of support SP1 and closer or further from the dual toroid assembly.

From the foregoing it can be seen that the secondary magnetic field introduced by magnet M can be utilized to partially saturate the ferrite material of toroids DT-1A and DT-1B. This of course changes the time for the ferrite material to become saturated for each on cycle, the net effect being to adjust pulse width of the duty cycle by use of the setting of permanent magnet M.

Support SP1 would probably be a plastic mounting means so constructed with ears or similar construction so as to be placed readily through on a spring basis to mounting holes in a printed circuit board such as PC1. The mounting means would then be snapped into the printed circuit board, above where the toroid assembly is soldered thereto. The air gap to the inductor assembly would be initially set to the maximum side of the tolerance band. The magnetic screw would then be turned inward to increase its influence and to thereby reduce the output power level of the electronic ballast to the desired value. This could be readily accomplished on a production line basis or on an individually determined basis by the user.

While but a single embodiment of the present invention has been shown, it will be obvious to those skilled in the art that numerous modifications may be made without departing from the spirit of the present invention which shall be limited only by the scope of the claims appended hereto.

What is claimed is:

1. An electronic ballast connected to a fluorescent lamp comprising:
   - an inverter circuit operated to convert direct current to high voltage alternating current;
   - first and second transistors;
   - and a dual toroid coil assembly functioning with said transistors to form said inverter circuit;
   - dimmer control means consisting of a permanent magnet located in proximity to said dual toroid coil assembly to control the saturation of said dual toroid coil assembly, said saturation determining the width of pulses generated by said first and second transistors whereby said high voltage alternating current for operation of said fluorescent lamp is limited to control the intensity of light emitted therefrom:
   - and support means for said permanent magnet.
2. An electronic ballast as claimed in claim 1 wherein: said permanent magnet is suspended over said dual toroid coil assembly.
3. An electronic ballast as claimed in claim 1 wherein: said permanent magnet is threaded;
   - said support means are also threaded to receive said permanent magnet.
4. An electronic ballast as claimed in claim 3 wherein: said permanent magnet includes adjustment means for facilitating the positioning within said support of said permanent magnet whereby said permanent magnet may be positioned closer to or in the alternative further from said dual toroid coil assembly, whereby the degree of saturation of said coil assembly may be varied.
5. An electronic ballast as claimed in claim 4 wherein: said permanent magnet adjustment means includes a slot adapted to be engaged by a screwdriver.
6. An electronic ballast as claimed in claim 1 wherein: said support means includes a plurality of engaging means for positioning said support on a printed circuit board supporting said dual toroid coil assembly.

* * * * *